US009261040B2

(12) United States Patent
Gibson et al.

(10) Patent No.: US 9,261,040 B2
(45) Date of Patent: Feb. 16, 2016

(54) METHOD FOR IMPROVING ENGINE STARTING

(71) Applicant: Ford Global Technologies, LLC, Dearborn, MI (US)

(72) Inventors: Alex O'Connor Gibson, Ann Arbor, MI (US); Brad Alan VanDerWege, Plymouth, MI (US); Cindy Zhou, Canton, MI (US); Jianwen James Yi, West Bloomfield, MI (US); John Eric Rollinger, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 371 days.

(21) Appl. No.: 13/826,129

(22) Filed: Mar. 14, 2013

(65) Prior Publication Data

US 2014/0278005 A1 Sep. 18, 2014

(51) Int. Cl.

| | |
|---|---|
| ***F02N 19/00*** | (2010.01) |
| ***F02D 41/02*** | (2006.01) |
| ***F02D 41/30*** | (2006.01) |
| ***F02D 41/06*** | (2006.01) |
| ***F02D 41/04*** | (2006.01) |
| ***F02D 41/10*** | (2006.01) |
| ***F02D 41/12*** | (2006.01) |

(52) U.S. Cl.

CPC ..... *F02D 41/30* (2013.01); *F02D 41/042* (2013.01); *F02D 41/062* (2013.01); *F02D 41/064* (2013.01); *F02D 41/105* (2013.01); *F02D 41/126* (2013.01); *F02D 41/3005* (2013.01); *F02N 19/005* (2013.01); *F02D 2200/0616* (2013.01); *F02N 2019/008* (2013.01); *F02N 2200/021* (2013.01); *F02N 2200/022* (2013.01)

(58) Field of Classification Search

CPC ..... F02D 41/30; F02D 41/042; F02D 41/064; F02D 41/126; F02D 41/105; F02D 41/3005; F02D 41/062; F02N 19/005; F02N 2019/008; F02N 2019/002; F02N 2200/021; F02N 2200/022

USPC ..... 701/104, 112, 113; 123/179.3, 179.4

See application file for complete search history.

(56) References Cited

U.S. PATENT DOCUMENTS

| | | | | |
|---|---|---|---|---|
| 6,568,372 | B1 * | 5/2003 | Kanno | 123/491 |
| 6,796,292 | B2 | 9/2004 | Lewis et al. | |
| 6,938,598 | B1 | 9/2005 | Lewis et al. | |
| 7,079,935 | B2 | 7/2006 | Lewis et al. | |
| 7,278,388 | B2 * | 10/2007 | Lewis et al. | 123/179.5 |
| 7,461,621 | B2 | 12/2008 | Ota et al. | |
| 7,587,270 | B2 * | 9/2009 | Tabata et al. | 701/112 |
| 7,949,461 | B2 * | 5/2011 | Takahashi | 701/113 |
| 2007/0079782 | A1 * | 4/2007 | Kassner et al. | 123/179.3 |
| 2007/0119403 | A1 * | 5/2007 | Laubender | 123/179.3 |
| 2008/0066706 | A1 * | 3/2008 | Nakamura et al. | 123/179.4 |
| 2008/0092841 | A1 * | 4/2008 | Takahashi | 123/179.16 |
| 2008/0103683 | A1 * | 5/2008 | Tabata et al. | 701/112 |
| 2010/0204902 | A1 * | 8/2010 | Kuroki et al. | 701/103 |
| 2012/0312277 | A1 * | 12/2012 | Santoso et al. | 123/435 |

* cited by examiner

*Primary Examiner* — Lindsay Low
*Assistant Examiner* — George Jin
(74) *Attorney, Agent, or Firm* — Julia Voutyras; Alleman Hall McCoy Russell & Tuttle LLP

(57) ABSTRACT

A method and system for improving starting of an engine that may be repeatedly stopped and started is presented. In one example, the method adjusts a port fuel injection amount in response to engine stopping position. The engine stopping position may be indicative of a fraction of injected fuel that enters a cylinder for a first combustion event since engine stop.

20 Claims, 4 Drawing Sheets

METHOD FOR IMPROVING ENGINE STARTING

FIELD

The present description relates to a system for improving starting of an engine. The method may be particularly useful for engines that are often stopped and then restarted.

BACKGROUND AND SUMMARY

It has been determined that it may be desirable under some conditions to automatically start and stop an engine of a vehicle. By automatically stopping an engine, it may be possible to reduce fuel consumption for a vehicle. For example, an engine may be stopped when a vehicle is at a stop light and forward motion is not desired. In this way, fuel consumption by the engine may cease for several minutes, thereby reducing fuel consumption. The engine may be restarted in response to a change in brake pedal state or an increase in driver demand torque. However, if the engine starts too lean or too rich after engine stopping, engine emissions may degrade such that the benefit of reduced fuel consumption is over shadowed by the increase in engine emissions.

The inventors herein have recognized the above-mentioned disadvantages and have developed a method for starting an engine, comprising: stopping the engine; and adjusting an amount of fuel supplied to a cylinder in response to engine stop position, the amount of fuel participating in a first combustion event since engine stop.

By adjusting an amount of fuel injected to a cylinder intake port in response to engine stop position, the amount of fuel participating in a first combustion event in the engine since engine stop, it may be possible to improve engine air-fuel control during engine starting. In particular, the engine stop position may provide an indication, or an ability to infer, an amount of injected fuel that will enter a cylinder via an intake port during engine starting. If engine position indicates less than the injected fuel amount is expected to enter the cylinder, the amount of fuel injected may be increased so that a desired amount of fuel enters the cylinder. In this way, it may be possible to provide more consistent engine air-fuel ratio control during engine starting.

The present description may provide several advantages. Specifically, the approach may improve engine starting consistency by reducing the possibility of engine misfire. In addition, the approach may improve engine starting emissions by providing more accurate air-fuel control. Further, the approach may improve engine run-up speed control by providing more repeatable engine torque during engine run-up to idle speed.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
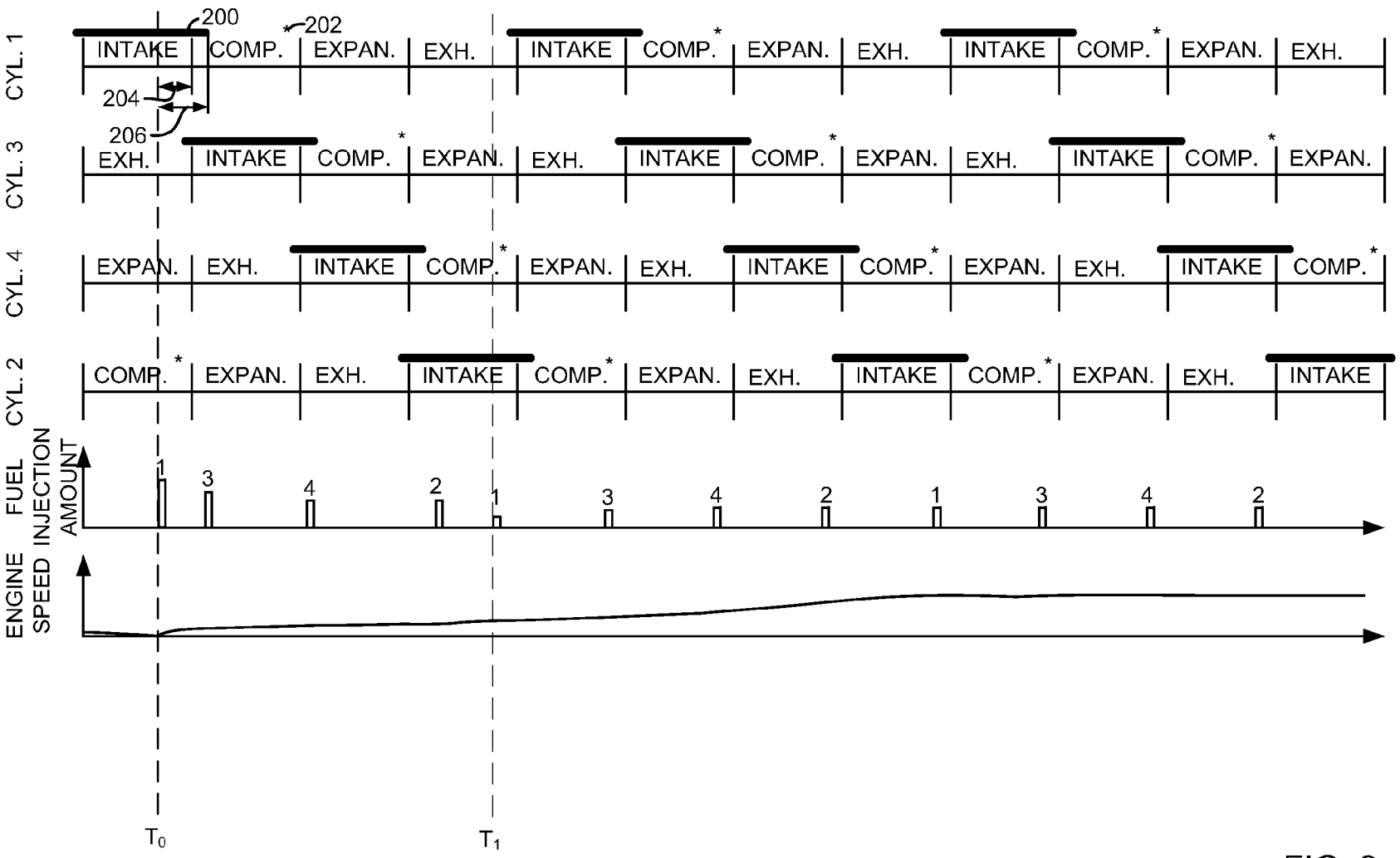
FIGS. 2 and 3 show example engine starting sequences.
Figure 3:
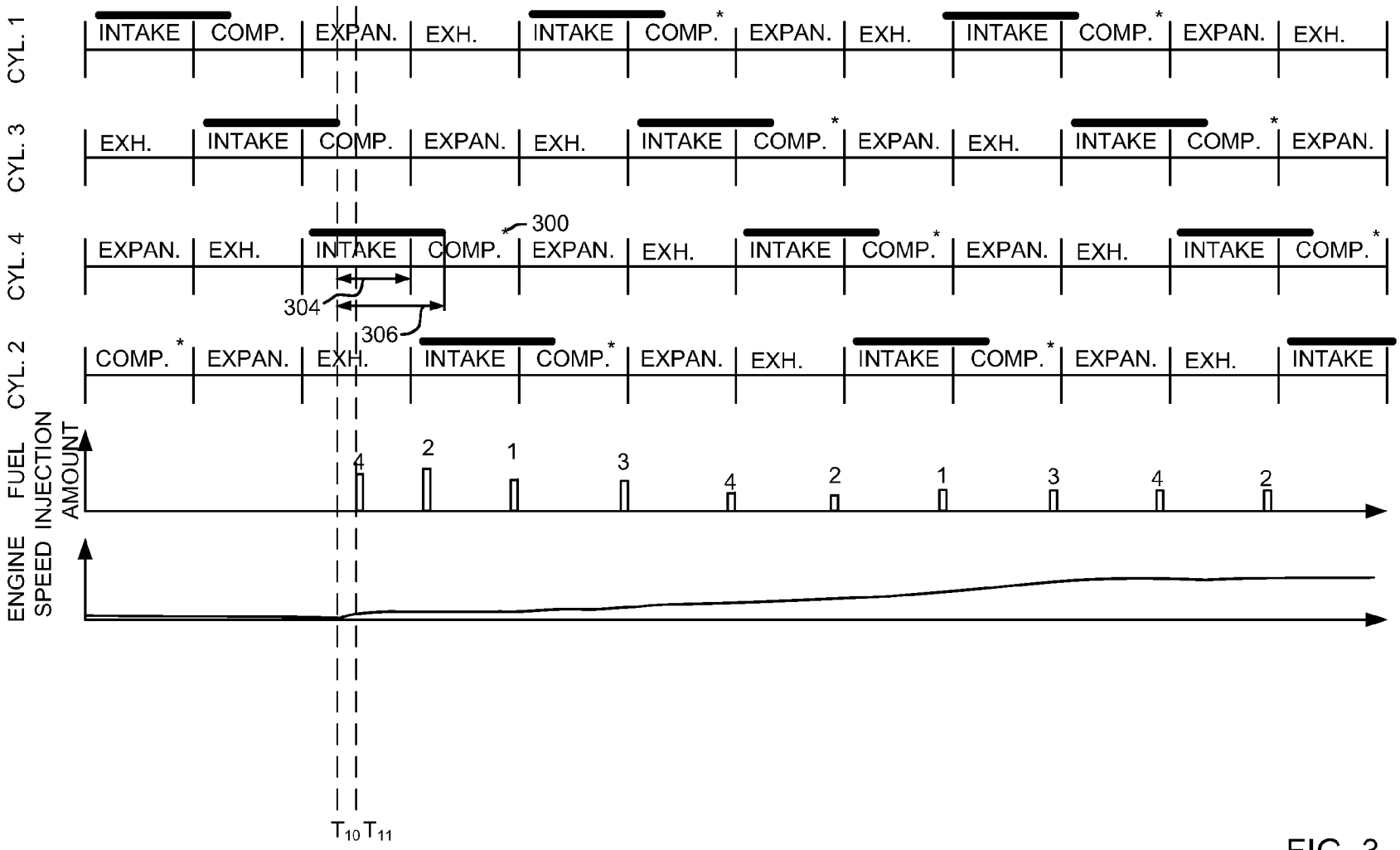
Figure 4:
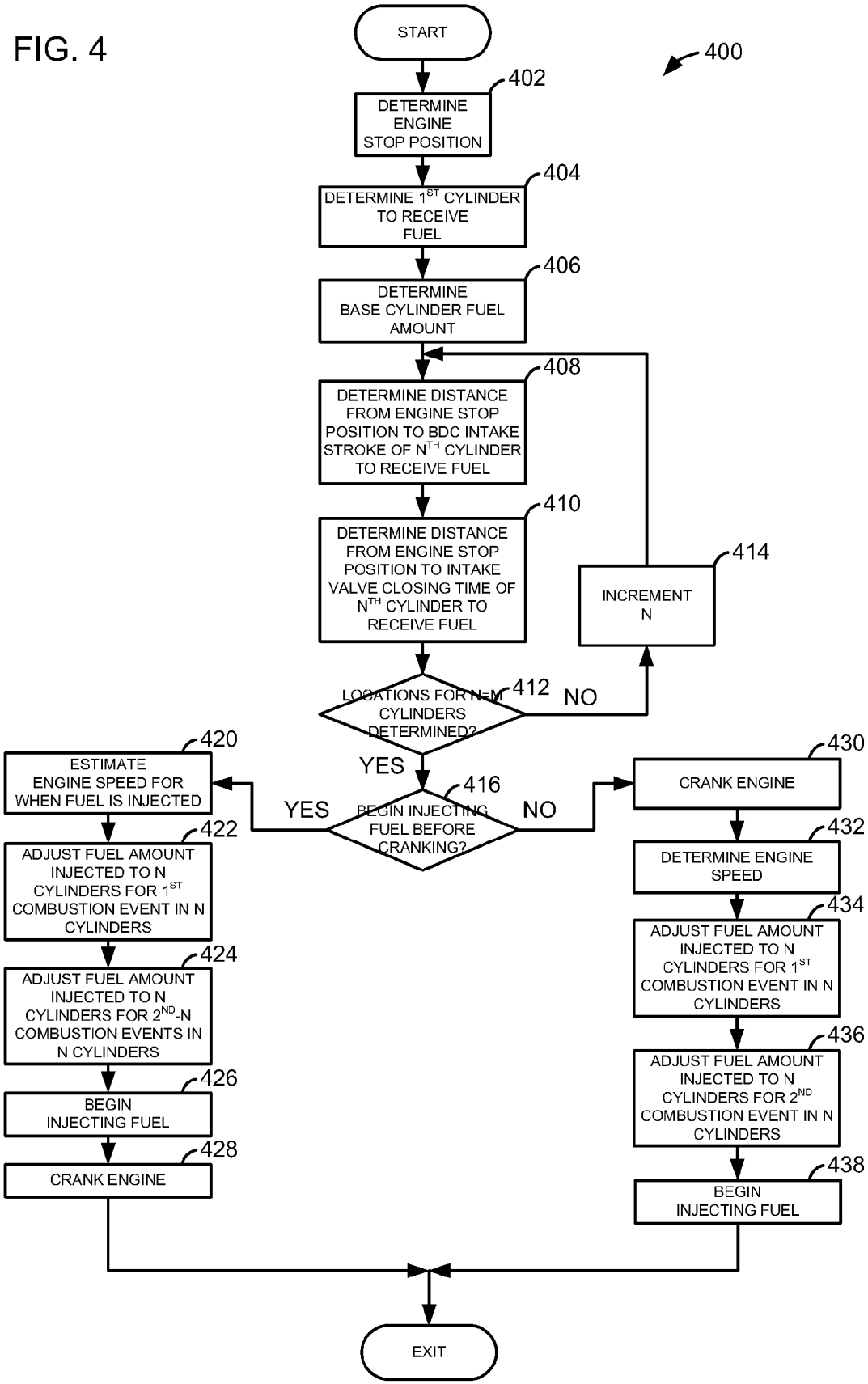
FIG. 4 is a flowchart of an example method for starting an engine.

The present description is related to automatically starting an engine. The methods described herein may be applied during warm or cold engine starts. FIGS. 2 and 3 show example engine starting sequences according to the method described in FIG. 4. The method of FIG. 4 provides for beginning to inject fuel to a cylinder port before engine cranking or beginning to inject fuel to the cylinder port after engine cranking begins.

Figure 1:
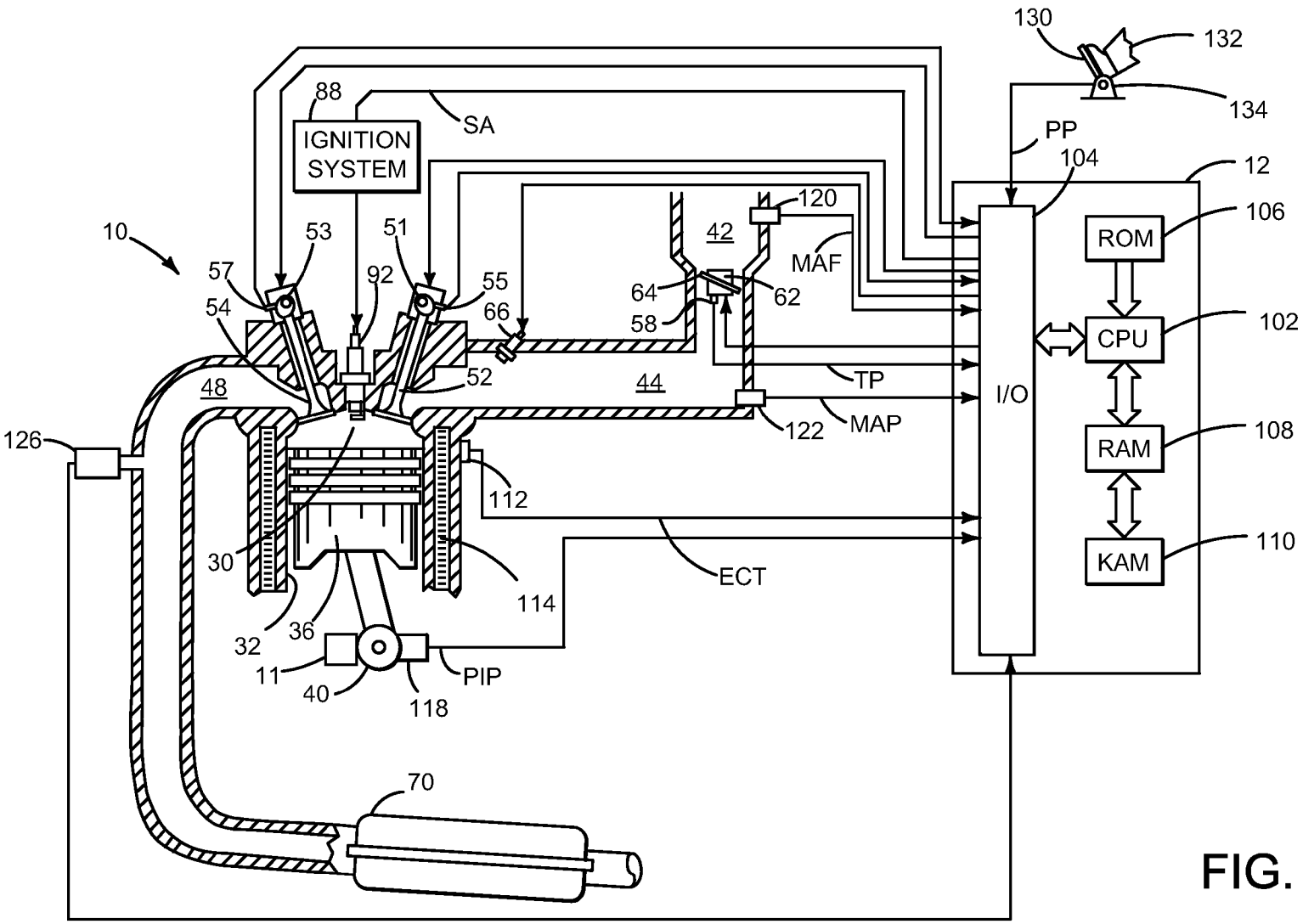
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Starter motor 11 may selectively engage and rotate crankshaft 40 during engine starting. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as port injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a V configuration engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for an engine system, comprising: an engine including a cylinder; a port fuel injector positioned to supply fuel to the cylinder; and a controller including non-transitory instructions for adjusting an amount of fuel supplied via the port fuel injector to the cylinder for a first combustion event in the cylinder since engine stop, the amount of fuel supplied to the cylinder adjusted in response to engine cranking speed irrespective of engine air flow. The engine system further comprises additional instructions for adjusting the amount of fuel supplied to the cylinder in response to an engine stop position.

The system of FIG. 1 also provides for additional instructions for adjusting the amount of fuel supplied to the cylinder in response to intake valve closing time of the cylinder relative to engine stop position. The engine system further comprises a second cylinder, and additional instructions to adjust an amount of fuel supplied to the cylinder for a second combustion event since engine stop in response to the engine cranking speed. The engine system further comprises additional instructions for injecting fuel a plurality of times via the port fuel injector during an intake stroke of the cylinder before the first combustion event. The engine system includes where the amount of fuel supplied to the engine via the port injector is decreased as engine cranking speed increases. In one example, the engine system further comprises additional instructions to automatically start the engine.

Referring now to FIG. 2, a first example engine starting sequence is shown. The sequence of FIG. 2 may be provided by the method of FIG. 4 in the system of FIG. 1.

FIG. 2. includes four plots of cylinder strokes for a four cylinder engine having a firing order of 1-3-4-2. The cylinder strokes of cylinder number one are in the plot that has a Y axis labeled CYL 1. Likewise, cylinder strokes for the remaining cylinders 2-4 are similarly labeled. The X axis represents engine position during an engine starting sequence. The amount of time for the engine to proceed through each stroke varies with engine speed, but the stroke intervals (e.g., 180 crankshaft degrees) are always the same. Thus, the time interval may be longer for the first couple of cylinder strokes during engine cranking, but the time between cylinder strokes decreases as engine speed increases. The X axis of each cylinder's stroke is labeled to designate the present stroke each cylinder is on at a point in time. For example, the sequence begins on the left side of the figure with cylinder number one on an intake stroke and proceeds to the right side of the figure. At the same time, cylinder number three is on an exhaust stroke, cylinder number four is on an expansion stroke, and cylinder number two is on a compression stroke.

Intake valve opening timings for each of the four cylinders are indicated by the wide lines above each cylinder stroke. For example, line 200 represents intake valve opening time for cylinder number one. The intake valve opens near top-dead-center intake stroke and closes after bottom-dead-center compression stroke. Similar valve timings are shown for cylinders 2-4. Spark timing for each cylinder is represented by an * such as is shown at 202.

The fifth plot shows fuel injection amount versus engine position, and each fuel injection amount is labeled according to the cylinder that is supplied the fuel amount. For example, the first fuel amount at time $T_0$ is labeled with a 1 to indicate that the fuel amount is supplied to the intake port of cylinder number one. Other fuel injections are marked to correspond to the cylinders in which fuel is injected to the port of the cylinder receiving the fuel. The Y axis of plot five is fuel injection amount and fuel injection amount increases in the direction of the Y axis arrow. The X axis represents engine position and the engine position is the same engine position as is shown for plots 1-4.

The sixth plot from the top of FIG. 2 shows engine speed versus engine position. The Y axis represents engine speed and engine speed increases in the direction of the Y axis arrow. The X axis represents engine position and the engine position is the same engine position as is shown for plots 1-4.

All six plots are shown relative to the engine position shown for cylinders one through four. The engine is stopped at time $T_0$ and decelerating to stop at time to the left of time $T_0$ in response to an automatic engine stop. An automatic engine stop may be initiated by a controller when selected conditions, not including a specific request by a driver via an input that has a sole function to stop and/or start the engine. For example, the engine may be automatically stopped when vehicle speed is zero and when the vehicle brake pedal is depressed. At time $T_0$, the engine is stopped for a period of time before being automatically restarted (e.g., the engine is restarted via a controller without an operator specifically requesting an engine start via an input that has a sole function of starting and/or stopping the engine, such as an ignition switch). The period of time that the engine is stopped may vary. The engine is rotating and being started during time to the right of time $T_0$.

The engine starting sequence in this example begins at time $T_0$ where an automatic engine start request is issued. The automatic engine start request may be issued in response to an operator releasing a brake pedal or another condition. In this example, fuel injection begins before engine cranking and engine rotation. The controller determines engine position at time of starting. Engine position may be determined from a record of engine position as determined when the engine was stopped or from reading engine position sensors while the engine is stopped.

Once engine position is determined, a first cylinder to receive fuel after the engine is stopped is selected. The first cylinder selected to receive fuel may be based on which cylinder can induct port injected fuel and provide a first combustion event before any of the other cylinders. In one example, the first cylinder to receive fuel is a cylinder that has at least one of its intake valves in an open position while the engine is stopped. If more than one cylinder has an open intake valve, the first cylinder selected is a cylinder that can induct fuel to provide a desired cylinder air-fuel mixture and provide a first combustion event since engine stop.

In this example, the engine is stopped with the intake valve of cylinder number one in an open position. Therefore, the first fuel injection is delivered to the intake port of cylinder number one as indicated in the fifth plot at time $T_0$. The amount of fuel provided in the first fuel injection is determined based on a desired air-fuel ratio in the cylinder, engine stopping position relative to bottom dead center intake stroke of cylinder number one 204 (e.g., the first cylinder to combust an air fuel mixture since engine stop), intake valve closing time of cylinder number one with respect to engine stopping position 206, engine temperature, and engine speed. Since fuel injection in this example begins before cranking, engine speed is zero, and therefore, it may be desirable to inject more fuel than an amount of fuel in the cylinder that would provide a desired air fuel ratio in the cylinder. The excess fuel injected into the port may be restricted from entering the cylinder by the intake valve position, intake port wall wetting, and insufficient velocity of air in the intake runner to draw the fuel into the cylinder due to low engine speed.

In this example, the engine stopping position is toward bottom dead center intake stroke (e.g., the vertical marker between intake and compression strokes in the first plot from the top of FIG. 2). Consequently, the intake valve is on or moving toward a closing trajectory and there is little time for the injected fuel to enter the cylinder. Further, since the engine is at a position approaching bottom dead center intake stroke of cylinder number one, the velocity of air entering the cylinder when the engine begins to crank may be low. Therefore, the fuel injection amount is increased responsive to the engine position relative to bottom dead center intake stroke of cylinder number one and intake valve closing time of cylinder number one. The amount of fuel injected may be increased via increasing the fuel injection time and/or increasing fuel injection pressure.

The engine is rotated or cranked via a starter or a motor after fuel injection to cylinder number one begins. Fuel is injected to the intake ports during open intake valve timing of cylinders 2-4 for first combustion events in those cylinders since engine stop. The fuel injection time is also adjusted to begin near intake valve opening time in cylinders 2-4 so that a greater fraction of the fuel injected enters the respective cylinders for a first combustion event. The amount of fuel injected to the intake port of cylinder three for its first combustion event since engine stop is less than the amount of fuel injected to cylinder number one for its first combustion event since engine stop. The reduction in injected fuel amount is based on the increased engine speed at the time of injecting fuel to cylinder number three and the number of crankshaft degrees between when fuel is injected and intake valve closing of cylinder number three occurs. The amount of fuel injected to cylinders numbered four and two is also reduced as engine speed increases in response to combustion in cylinder number one.

At time $T_1$, the amount of fuel injected to the intake port of cylinder number one for a second combustion event is decreased in response to an estimate of fuel that did not enter cylinder number one at and after time $T_0$. At least a portion of fuel injected at time $T_0$ enters cylinder number one for the second intake stroke of cylinder number one since engine stop. Therefore, the amount of fuel injected to the intake port of cylinder number one is reduced so that a desired air-fuel ratio will be formed in cylinder number one for a second combustion event since engine stop. In some examples, a fuel intake port puddle estimate tracks fuel injected to the port that enters and exits a fuel puddle in the cylinder port. Further, the fuel injection timing for cylinder number one and other engine cylinders is adjusted so that fuel injection occurs before intake valve opening of the cylinder receiving the fuel. In other words, the fuel injection timing is adjusted from open intake valve fuel injection to closed intake valve injection. By injecting fuel to cylinder intake ports and adjusting the amount of fuel injected responsive to engine stopping position, engine stop position relative to intake valve closing time, and engine cranking speed, it may be possible to improve engine air-fuel control and reduce engine starting time.

Referring now to FIG. 3, a second example engine starting sequence is provided. The engine starting sequence in FIG. 3 is similar to the starting sequence in FIG. 2. Further, the plots of FIG. 3 are similar to the plots of FIG. 2. Therefore, a description of the individual plots of FIG. 3 is omitted for the sake of brevity and the description in FIG. 2 applies to FIG. 3 except as indicated below.

In the engine starting sequence of FIG. 3, intake valve timing is retarded as compared to intake valve closing times shown in FIG. 2. Engine valve closing time may be retarded to effectively reduce cylinder's compression ratio or to increase gas velocity in engine cylinder intake ports during starting. The engine is automatically stopped before time $T_{10}$, and the engine reaches a stopped position at time $T_{10}$. In this example, the engine is stopped while the intake valve of cylinder number four is open. The engine stop position is closer to top dead center intake stroke for cylinder number four than to bottom dead center intake stroke. The engine may be stopped for a variable amount of time depending on vehicle operating conditions. The engine is automatically restarted at time $T_{10}$ in response to vehicle operating conditions. Specifically, the engine is cranked and begins to rotate without fuel being injected to a cylinder.

At time $T_{11}$, a first fuel injection to a cylinder port of cylinder number four begins. The amount of fuel injected at time $T_{11}$ is less than the amount of fuel injected at time $T_0$ in FIG. 2. Less fuel is injected at time $T_{11}$ because the engine was stopped at a position where the first cylinder to receive fuel since engine stop, cylinder number four, is closer to top dead center intake stroke than bottom dead center intake stroke (e.g., distance 304). Consequently, the piston of cylinder number four can travel a longer distance before reaching bottom dead center intake stroke than cylinder number one at time $T_0$ in FIG. 2. However, since intake valve closing timing has more retard than the intake valve timing shown in FIG. 2

(e.g., the distance from engine stopping position to intake valve closing timing 306), the amount of fuel injected is not reduced as much as would be the case if intake valve timing were more advanced. Additionally, engine speed has increased and is greater than zero so that gas velocity in cylinder intake ports may be higher. Therefore, the amount of fuel injected to the intake port of cylinder number four is decreased further in response to the higher engine speed at the time of fuel injection.

The fuel injection amounts for cylinders one, two, and three are also increased as compared to the cylinders providing the second, third, and fourth combustion events in FIG. 2 because the intake valve closing times shown in FIG. 3 are retarded. The retarded intake valve timing shown in FIG. 3 may allow a portion of fuel entering the cylinders to be pumped back into the engine intake manifold. Consequently, the injected fuel amount may be increased so that the desired amount of fuel remains in the cylinder at the time of combustion.

The amount of fuel injected to cylinder number four of FIG. 3 for its second combustion event since engine stop is greater than the amount of fuel injected to cylinder number one for its second combustion event shown in FIG. 2. The amount of fuel injected into cylinder number four of FIG. 3 for its second combustion event since engine stop is increased because less fuel from the first injection into cylinder number four is drawn into cylinder number four for its second combustion event. Less fuel enters cylinder four from a first injection into the port of cylinder number four because a greater fraction of injected fuel enters the cylinder for a first combustion event. Additionally, fuel injection timing is transitioned from open valve fuel injection to closed valve fuel injection after two cylinder intake events instead of after an entire engine cycle (e.g., two engine rotations for the four stroke engine illustrated).

In this way, fuel may be supplied to a port fuel injected engine during an automatic engine start to improve engine starting. Start of injection timing for a first combustion event in a cylinder that has an intake valve open at engine stop may be delayed to a time later in the same intake stroke to allow engine speed to increase so that a greater fraction of injected fuel enters the cylinder.

Referring now to FIG. 4, a method for starting an engine is shown. The method of FIG. 4 may be stored as executable instructions in non-transitory memory of controller 12 shown in FIG. 1. The method of FIG. 4 may also provide the starting sequences shown in FIGS. 2 and 3.

At 402, method 400 determines engine stop position. The engine may be stopped automatically via a controller without a driver's input to a device that has a sole purpose of starting and/or stopping the engine. Alternatively, the engine may be stopped via a driver command. After an engine stop request is received, engine position may be tracked while the engine decelerates to zero speed to determine engine position when engine rotation stops. Alternatively, engine position may be determined via reading engine position sensor information when the engine is stopped. Method 400 proceeds to 404 after engine stop position is determined.

At 404, method 400 selects a first cylinder for combustion in response to a request to start the engine. The engine may be automatically started by a controller or it may be started in response to a driver's input to a device that has a sole purpose of starting and/or stopping the engine. In one example, the cylinder selected for a first combustion event since engine stop is based on a cylinder that is stopped with an intake valve in an open state. The cylinder that is stopped with an intake valve in an open state is supplied fuel while the intake valve is open so that a first combustion event since engine stop may be provided within a shorter engine cranking interval (e.g. while rotating the engine via a motor). If a cylinder intake valve is within a threshold number of crankshaft degrees before closing, method 400 may select a cylinder next in the engine's firing order for a first combustion event. For example, if a four cylinder engine having a firing order of 1-3-4-2 stops in a position where the intake valve of cylinder number three is within 5 crankshaft degrees of closing, method 400 selects cylinder number four as the cylinder to provide a first combustion event since engine stop.

If two or more cylinders have an intake valve in an open state while the engine is stopped, method 400 selects a cylinder that is closest to its intake valve closing timing (e.g., 20 crankshaft degrees after bottom dead center intake stroke) and at least more than a threshold number of crankshaft degrees away from its intake valve closing time. Method 400 proceeds to 406 after a cylinder is selected for a first combustion event since engine stop. In some examples, the cylinder selected for a first combustion event since engine stop is the first cylinder to receive fuel after engine stop.

At 406, method 400 determines a base cylinder fuel amount for the first cylinder to combust fuel since engine stop. The base cylinder fuel amount is determined from engine coolant temperature and an estimated amount of air that is trapped in the cylinder after intake valve closing. In one example, cylinder air charge is estimated based on intake manifold pressure. The base fuel amount is based on a desired cylinder air-fuel ratio for the estimated cylinder air charge. The base cylinder fuel amount for other cylinders may be determined in a similar manner. After engine speed reaches idle speed, the base fuel amount may be based on output of an air meter. Method 400 proceeds to 408 after the base cylinder fuel amounts are determined.

At 408, method 400 determines the distance between the engine stopping position and bottom dead center intake stroke of the $N^{th}$ cylinder scheduled for a combustion event since engine stop. For example, N begins at a value of one and the distance between the engine stopping position and bottom dead center intake stroke of the first cylinder scheduled for a first combustion event since engine stop is determined. In addition, the distance between the engine stopping position and different engine event locations (e.g., top dead center intake stroke) may be determined.

In one example, the number of crankshaft degrees between the engine stopping position and bottom dead center intake stroke of the $N^{th}$ cylinder scheduled for a combustion event since engine stop is determined by looking up the crankshaft degree location of bottom dead center intake stroke position of the $N^{th}$ cylinder scheduled for a combustion event since engine stop and subtracting it from the engine stop position. The crankshaft locations of selected engine positions (e.g., bottom dead center intake stroke) may be stored in controller memory and retrieved when desired. Method 400 proceeds to 410 after the distance between the engine stopping position and bottom dead center intake stroke of the $N^{th}$ cylinder scheduled for a combustion event since engine stop is determined.

At 410, method 400 determines the distance between the engine stopping position and intake valve closing timing of the $N^{th}$ cylinder scheduled for a combustion event since engine stop. For example, N begins at a value of one and the distance between the engine stopping position and intake valve closing timing of the first cylinder scheduled for a first combustion event since engine stop is determined.

In one example, the number of crankshaft degrees between the engine stopping position and intake valve closing timing of the cylinder scheduled for a combustion event since engine stop is determined by looking up the crankshaft degree location of intake valve closing timing of the cylinder scheduled for a combustion event since engine stop and subtracting it from the engine stop position. The crankshaft locations of intake valve closing timings may be stored in controller memory and retrieved when desired. Method 400 proceeds to 412 after the distance between the engine stopping position and intake valve closing timing of the cylinder scheduled for a combustion event since engine stop is determined.

At 412, method 400 judges whether or not distances between the engine stopping position and selected cylinder related positions such as intake valve closing timing and/or bottom dead center intake stroke for a variable number M cylinders is determined. For example, where M=4 four, the distance between engine stopping position and selected cylinder related locations for four cylinders are determined. In some examples, M is equal to one and only distances between the engine stopping location and cylinder related positions of a single cylinder are determined. A variable N may be used as an index to sequentially determine distances between the cylinder related positions of the first cylinder to combust an air-fuel mixture since engine stop to the $N^{th}$ cylinder to combust an air-fuel mixture since engine stop. In this way, distances between engine stopping position and M cylinder related positions may be determined. N starts out at a value of 1 and may be increased. If N is a value less than M and not all distances for cylinder related positions are determined, the answer is no and method 400 proceeds to 414. Otherwise, the answer is yes and method 400 proceeds to 416.

At 414, method 400 increments N so that distances between engine stopping position and another cylinder may be determined. When N is incremented, the distance from engine stopping position and cylinder related positions in the next cylinder in an engine combustion order from the cylinder selected for a first combustion event is determined. Method 400 returns to 408 after N is incremented.

At 416, method 400 judges whether or not fuel injection to the cylinder ports is to begin before cranking or while cranking the engine via a motor. In one example, a bit stored in memory indicates whether fuel injection should start before or after engine cranking. In other examples, the engine stop position is the basis for determining whether fuel injection begins before or once engine cranking via a motor begins. For example, if intake valve closing time of the cylinder selected to provide a first combustion event since engine stop is within a predetermined number of crankshaft degrees of engine stop position, the answer is yes and method 400 proceeds to 420. Otherwise, the answer is no and method 400 proceeds to 430.

At 420, method 400 estimates engine speeds for when fuel is to be injected during open intake valve conditions. For example, if fuel injection to a first intake port of the first cylinder scheduled for a first combustion event since engine stop is scheduled before engine rotation, the estimated engine speed at time of injection for the first cylinder is zero. If fuel injection to a first intake port of the first cylinder scheduled for a second combustion event since engine stop is scheduled before for 60 crankshaft degrees after the engine stop position, the estimated engine speed at time of injection for the second cylinder is based on empirically determined values that are stored in a table or function. The table or function is indexed based on engine cranking degrees from engine stop to the selected engine position (e.g., 60 crankshaft degrees). The table or function outputs the estimated engine cranking speed, and the estimated engine cranking speed may be adjusted based on engine and ambient temperatures. If engine speed is high enough for engine speed sensors to function, engine speed from sensors may be the basis for determining engine speed at fuel injection time. Method 400 proceeds to 422 after engine speed for each open intake valve fuel injection is determined.

At 422, method 400 adjusts the fuel amount to be supplied to N cylinders for the first combustion event in each of the N cylinders or a prescribed number of combustion events since engine stop that is less than or equal to the number of engine cylinders. In one example, adjustments to the base fuel amount determined at 406 are empirically determined and stored in tables and/or functions. In particular, tables and/or functions that adjust the base fuel amount in response to the number of crankshaft angle degrees between engine stopping position and intake valve closing time for each of the N cylinders receiving fuel for a first combustion event in each of the N cylinders is output from the tables and/or functions. The tables and/or functions are indexed based on the distances determined at 410, and the values of fuel adjustments in the table are empirically determined.

Similarly, adjustments to the base fuel amounts determined at 406 are provided by tables and/or functions that are based on engine speed at the time of fuel injection and the crankshaft degrees between the engine stopping position and a selected engine position (e.g., bottom dead center intake stroke of the cylinder receiving the fuel). The individual base fuel adjustments based on engine speed, crankshaft distance between engine stopping position and intake valve closing, and crankshaft distance between engine stopping position and a selected engine position are added to the base fuel amount.

In one example, fuel is added to the base fuel amount as the distance between engine stopping position and intake valve closing time decreases to less than a threshold number of engine crankshaft degrees, the number of crankshaft degrees depending on the combustion event number since engine stop that the cylinder having the intake valve closing time corresponds with. For example, a distance between engine stopping position and a first cylinder scheduled for combustion after engine stop is 40 crankshaft degrees and the threshold crankshaft degrees for the first cylinder to combust an air-fuel mixture after engine stop is 60 crankshaft degrees, then the injected fuel amount for the first cylinder is increased. For the second cylinder to combust an air-fuel mixture since engine stop, a distance between engine stopping position and the second cylinder scheduled for combustion after engine stop is 220 crankshaft degrees and the threshold crankshaft degrees for the first cylinder to combust an air-fuel mixture after engine stop is 240 crankshaft degrees, then the injected fuel amount for the first cylinder is increased.

On the other hand, if a distance between engine stopping position and a first cylinder scheduled for combustion after engine stop is 70 crankshaft degrees and the threshold crankshaft degrees for the first cylinder to combust an air-fuel mixture after engine stop is 60 degrees, then the injected fuel amount is maintained. Likewise, for a second cylinder to combust an air-fuel mixture since engine stop, a distance between engine stopping position and the second cylinder scheduled for combustion after engine stop is 250 crankshaft degrees and the threshold crankshaft degrees for the first cylinder to combust an air-fuel mixture after engine stop is 240 crankshaft degrees, then the injected fuel amount for the first cylinder is maintained.

Further, the amount of fuel injected to a cylinder intake port may be decreased as engine cranking speed increases. The increased engine speed may help to improve vacuum generation in the engine cylinders, thereby improving fuel and air flow from the intake port into the cylinder. Similarly, if engine speed decreases, the amount of fuel injected to a cylinder port may be increased to compensate for less cylinder port gas velocity.

Additionally, the amount of fuel injected to a cylinder may increase as engine stopping position moves closer to bottom dead center of the cylinder into which fuel is being injected. As engine stopping position is moved closer to bottom dead center of the cylinder to receive fuel, the engine has less time to generate vacuum in the cylinder. Consequently, the cylinder provides less motive force to draw fuel into the cylinder. Therefore, additional fuel is injected to the cylinder so that a desired cylinder air-fuel is provided. In other words, a desired amount of fuel enters the cylinder by injecting more that the desired amount of fuel to the cylinder intake port. Method 400 proceeds to 424 after fuel adjustments for the first combustion events since engine stop in N cylinders is determined.

However, if intake stroke top dead center of the cylinder receiving fuel for a first combustion event after engine stop and engine stopping position are the basis for adjusting fuel injection amount, the fuel injection adjustment amount increases (e.g., more fuel is added to the base fuel amount) as the engine stopping position moves from top dead center intake stroke to bottom dead center intake stroke of the first cylinder receiving fuel for the first combustion event after the engine stop. On the other hand, if the engine stops before intake stroke top dead center of the cylinder receiving fuel for a first combustion event after engine stop, the fuel injection adjustment amount is zero and the base amount of fuel is injected. Of course, adjustments for intake valve closing time of the cylinder are also provided in addition to fuel amount adjustments for the number of crankshaft degrees between engine stopping position and top dead center intake stroke of the cylinder receiving fuel for a first combustion event since engine stop.

At 424, method 400 adjusts the fuel amount to be supplied to N cylinders for the second combustion event in each of the N cylinders. In one example, adjustments to the base fuel amount determined at 406 for second combustion events in cylinders are empirically determined and stored in tables and/or functions. In particular, tables and/or functions that adjust the base fuel amount in response to the number of crankshaft angle degrees between engine stopping position and intake valve closing time for each of the N cylinders receiving fuel for a second combustion event in each of the N cylinders is output from the tables and/or functions. The tables and/or functions are indexed based on the distances determined at 410, and the values of fuel adjustments in the table are empirically determined. Adjustments for engine speed, crankshaft distance between engine stopping position and intake valve closing, and crankshaft distance between engine stopping position and bottom dead center of the cylinder receiving fuel similar to adjustments described at 422 are provided for second combustion events in engine cylinders. Method 400 proceeds to 426 after fuel adjustments for the second combustion events in engine cylinders are added to the base fuel injection amounts.

At 426, each of the base fuel amounts along with fuel adjustments determined at 422 and 424 are supplied to intake ports of cylinders beginning at engine stop and continuing for a predetermined number of fuel injections. For example, a base fuel amount and fuel amount adjustments for engine speed, crankshaft distance between engine stop position and intake valve closing timing of the first cylinder scheduled for a first combustion event, and crankshaft distance between engine stop position and bottom dead center of the first cylinder scheduled for a first combustion event are injected to the first cylinder scheduled for a combustion event before the engine begins to rotate. As the engine begins to rotate, a base fuel amount and fuel amount adjustments for engine speed, crankshaft distance between engine stop position and intake valve closing timing of the second cylinder scheduled for a first combustion event, and crankshaft distance between engine stop position and bottom dead center of the second cylinder scheduled for a first combustion event are injected to the second cylinder scheduled for a first combustion event and so on.

Further, in some examples fuel may be injected a plurality of times to a cylinder intake port during a cylinder cycle while an intake valve of the cylinder is opened. The amount of each of the plurality of fuel injections may be based on engine stopping position. For example, if an engine is stopped during an intake stroke of a cylinder scheduled for a first combustion event since engine stop at 170 crankshaft degrees before closing time of the cylinder's intake valve, the plurality of fuel injections during the cylinder cycle may be provided at a base predetermined timing. However, if the engine stops 90 crankshaft degrees before closing time of the cylinder's intake valve, an amount of fuel in the first fuel injection of the plurality of fuel injections may be increased so that there is a greater possibility of the fuel entering the cylinder. Method 400 proceeds to 428 after fuel injection begins.

At 428, method 400 begins to crank the engine via a motor and the base fuel amounts and fuel adjustments are provided to cylinders to which they are scheduled. Thus, fuel injection and fuel amount adjustments begin before the engine rotates and then continue as the engine rotates. In this way, the amount of fuel injected to each cylinder port is adjusted to account for engine conditions that may affect how much of the injected fuel actually enters the cylinders. As a result, engine air fuel control during engine starting may be improved.

At 430, the engine cranking begins before fuel injection. The engine may be cranked via a starter or a motor of a hybrid powertrain. Method 400 proceeds to 432 after the engine begins to rotate.

At 432, method 400 determines engine speed. Engine speed may be determined via engine position sensors. Method 400 proceeds to 434 after engine speed is determined.

At 434, method 400 adjusts a fuel amount delivered to N cylinders for a first combustion event since engine stop in each of the N cylinders. Method 400 adjusts the fuel amount as is described at 422 and proceeds to 436.

At 436, method 400 adjusts a fuel amount delivered to N cylinders for a second combustion event since engine stop in each of the N cylinders. Method 400 adjusts the fuel amount as is described at 424 and proceeds to 438.

At 438, method 400 begins injecting each of the base fuel amounts along with fuel adjustments determined at 434 and 436 are supplied to intake ports of cylinders beginning at engine stop and continuing for a predetermined number of fuel injections. In particular, a base fuel amount and fuel amount adjustments for engine speed, crankshaft distance between engine stop position and intake valve closing timing of the first cylinder scheduled for a first combustion event, and crankshaft distance between engine stop position and bottom dead center of the first cylinder scheduled for a first combustion event are injected to the first cylinder scheduled for a combustion event before the engine begins to rotate.

Additionally, in some examples fuel may be injected a plurality of times to a cylinder intake port during a cylinder cycle while an intake valve of the cylinder is opened. The amount of each of the plurality of fuel injections may be based on engine stopping position. For example, if an engine is stopped during an intake stroke of a cylinder scheduled for a first combustion event since engine stop at 170 crankshaft degrees before closing time of the cylinder's intake valve, the plurality of fuel injections during the cylinder cycle may be provided at a base predetermined timing. However, if the engine stops 90 crankshaft degrees before closing time of the cylinder's intake valve, an amount of fuel in the first fuel injection of the plurality of fuel injections may be increased so that there is a greater possibility of the fuel entering the cylinder. Method 400 proceeds to exit after fuel injection begins.

In this way, injection of fuel to cylinder intake ports may begin after an engine begins to rotate during engine starting. The fuel injection amounts can be adjusted to compensate for engine conditions at engine stop that may affect a fraction of injected fuel that enters a cylinder during engine starting.

Thus, the method of FIG. 4 provides for a method for starting an engine comprising: stopping the engine; and adjusting an amount of fuel supplied to a cylinder intake port in response to engine stop position, the amount of fuel participating in a first combustion event since engine stop. The method includes where the amount of fuel supplied to the cylinder intake port is supplied via a port fuel injector.

In some examples, the method further comprises adjusting the amount of fuel injected to the cylinder intake port in response to the engine stopping position relative to bottom dead center intake stroke of a cylinder receiving the amount of fuel supplied to the cylinder intake port. The method also includes where the amount of fuel supplied to the cylinder intake port is increased as the engine stopping position moves closer to bottom dead center intake stroke of the cylinder. The method also includes where the amount of fuel supplied to the cylinder intake port is injected during an open intake valve condition of a cylinder receiving the amount of fuel supplied to the cylinder intake port. The method further comprises adjusting the amount of fuel supplied to the cylinder intake port in response to engine cranking speed. The method further comprises adjusting an amount of fuel supplied to the cylinder intake port for a second combustion event since engine stop in a cylinder receiving the amount of fuel supplied to the cylinder intake port based on an estimate of an amount of fuel that did not enter the cylinder for the first combustion event since engine stop.

The method of FIG. 4 also provides for a method for starting an engine, comprising: stopping the engine; and adjusting an amount of fuel supplied to an intake port of a cylinder for a first combustion event since engine stop in response to intake valve closing timing of the cylinder relative to engine stop position. The method includes where the amount of fuel supplied to the intake port increases as engine stop position approaches the intake valve closing time. The method further comprises adjusting the amount of fuel supplied to the intake port in response to engine cranking speed.

In another example, the method further comprises adjusting the amount of fuel supplied to the intake port in response to the engine stop position relative to bottom dead center intake stroke of the cylinder. The method further comprises adjusting an amount of fuel supplied to the intake port of the cylinder in response to an estimate of fuel that did not enter the cylinder for the first combustion event since engine stop. The method further comprises adjusting an amount of fuel supplied to an intake port of a second cylinder for a second combustion event since engine stop in response to intake valve closing time of the second cylinder relative to engine stop position.

As will be appreciated by one of ordinary skill in the art, routine described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for starting an engine, comprising:

stopping the engine; and adjusting an amount of fuel supplied to a cylinder intake port in response to engine stop position and engine speed, the amount of fuel participating in a first combustion event since engine stop.

2. The method of claim 1, where the amount of fuel supplied to the cylinder intake port is supplied via a port fuel injector, and further comprising selecting a first cylinder for combustion since engine stop, the first cylinder a cylinder next in engine firing order from a cylinder that is on an intake stroke with an intake valve that closes within a threshold number of crankshaft degrees from an engine stop position.

3. The method of claim 1, further comprising adjusting the amount of fuel supplied to the cylinder intake port in response to the engine stop position relative to bottom dead center intake stroke of a cylinder receiving the amount of fuel supplied to the cylinder intake port.

4. The method of claim 3, where the amount of fuel supplied to the cylinder intake port is increased as the engine stop position moves closer to bottom dead center intake stroke of the cylinder.

5. The method of claim 1, where the amount of fuel supplied to the cylinder intake port is injected during an open intake valve condition of a cylinder receiving the amount of fuel supplied to the cylinder intake port.

6. The method of claim 1, further comprising adjusting the amount of fuel supplied to a second cylinder's intake port for a first combustion event in a second cylinder in response to engine cranking speed, and where the amount of fuel supplied to the second cylinder's intake port is decreased as engine speed increases.

7. The method of claim 1, further comprising adjusting an amount of fuel supplied to the cylinder intake port for a second combustion event since engine stop in a cylinder receiving the amount of fuel supplied to the cylinder intake port based on an estimate of an amount of fuel that did not enter the cylinder for the first combustion event since engine stop.

8. A method for starting an engine, comprising:

stopping the engine; and adjusting an amount of fuel supplied to an intake port of a cylinder for a first combustion event since engine stop in response to intake valve closing timing of the cylinder relative to engine stop position.

9. The method of claim 8, where the amount of fuel supplied to the intake port increases as engine stop position approaches the intake valve closing time.

10. The method of claim 8, further comprising adjusting the amount of fuel supplied to the intake port in response to engine cranking speed.

11. The method of claim 8, further comprising adjusting the amount of fuel supplied to the intake port in response to the engine stop position relative to bottom dead center intake stroke of the cylinder.

12. The method of claim 8, further comprising adjusting the amount of fuel supplied to the intake port of the cylinder in response to an estimate of fuel that did not enter the cylinder for the first combustion event since engine stop.

13. The method of claim 8, further comprising adjusting an amount of fuel supplied to an intake port of a second cylinder for a second combustion event since engine stop in response to intake valve closing timing of the second cylinder relative to engine stop position.

14. An engine system, comprising:

an engine including a cylinder;

a port fuel injector positioned to supply fuel to the cylinder; and a controller including non-transitory instructions for adjusting an amount of fuel supplied via the port fuel injector to the cylinder for a first combustion event in the cylinder and the engine since engine stop, the amount of fuel supplied to the cylinder decreased in response to increasing engine cranking speed irrespective of engine air flow.

15. The engine system of claim 14, further comprising additional instructions for adjusting the amount of fuel supplied to the cylinder in response to an engine stop position.

16. The engine system of claim 14, further comprising additional instructions for adjusting the amount of fuel supplied to the cylinder in response to intake valve closing time of the cylinder relative to engine stop position.

17. The engine system of claim 14, further comprising a second cylinder, and additional instructions to adjust an amount of fuel supplied to the cylinder for a second combustion event since engine stop in response to the engine cranking speed.

18. The engine system of claim 14, further comprising additional instructions for injecting fuel a plurality of times via the port fuel injector during an intake stroke of the cylinder before the first combustion event.

19. The engine system of claim 14, further comprising selecting a first cylinder for combustion since engine stop, the first cylinder a cylinder next in engine firing order from a cylinder that is on an intake stroke with an intake valve that closes within a threshold number of crankshaft degrees from an engine stop position.

20. The engine system of claim 14, further comprising additional instructions to automatically start the engine.

* * * * *